United States Patent [19]

Gallagher

[11] 3,934,529

[45] Jan. 27, 1976

[54] ICEBREAKING VESSELS

[75] Inventor: John Patrick Gallagher, Calgary, Canada

[73] Assignee: Canadian Marine Drilling Ltd., Calgary, Canada

[22] Filed: Oct. 30, 1974

[21] Appl. No.: 519,484

[30] Foreign Application Priority Data

Sept. 16, 1974 Canada ..... 209254

[52] U.S. Cl. ..... 114/40

[51] Int. Cl.[2] ..... B63B 35/08

[58] Field of Search ..... 114/40, 41

[56] References Cited

UNITED STATES PATENTS

| | | | |
|---|---|---|---|
| 3,572,270 | 3/1971 | Wood | 114/40 |
| 3,698,341 | 10/1972 | Wagner | 114/40 |
| 3,841,252 | 10/1974 | Bennet et al | 114/40 |
| 3,850,125 | 11/1974 | Anders | 114/40 |

*Primary Examiner*—Trygve M. Blix
*Assistant Examiner*—Gregory W. O'Connor
*Attorney, Agent, or Firm*—Fred Philpitt

[57] ABSTRACT

A procedure and a novel vessel are provided for breaking ice. The procedure comprises the cyclical steps of firstly pretensioning an ice-sheet by plowing under a portion of the ice-sheet with the bow of an icebreaking vessel; secondly superimposing on that pretensioned ice-sheet, a massive momentum force due to the reaction of an impulse force due to accelerating water rapidly downwardly from within a bow chamber; and finally refilling the bow chamber with water. Preferably the impulse force is created by the high pressure exhaust gases from a combustion chamber, e.g. an explosive combustion chamber being applied directly to the water.

5 Claims, 1 Drawing Figure

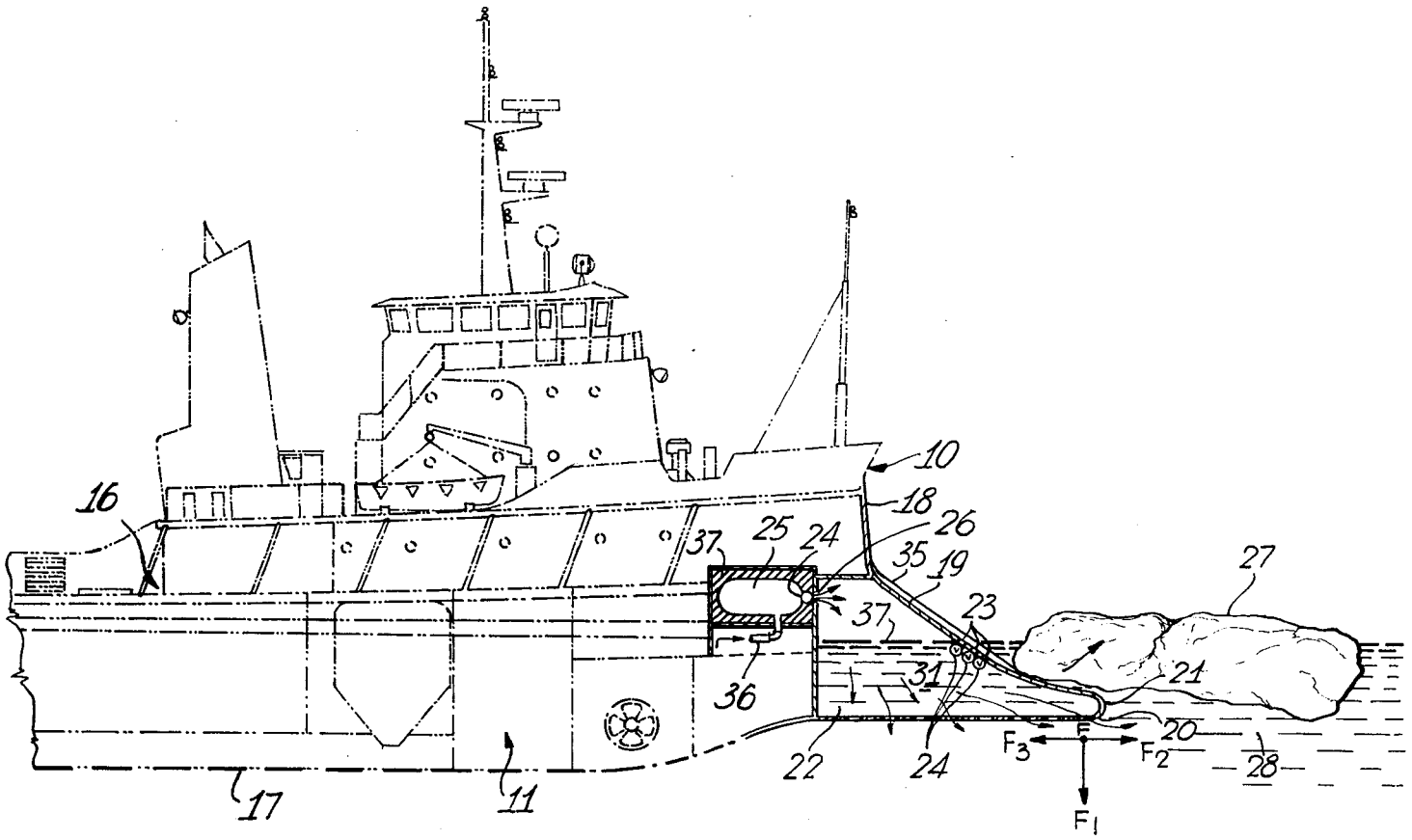
10
11
16
17
18
19
20
21
22
23
24
25
26
27
28
31
35
36
37
F1
F2
F3

ICEBREAKING VESSELS

BACKGROUND OF THE INVENTION a. Field of the Invention

This invention relates to vessels for use in icecovered waters, such as, for example, icebreaking ships, and to novel procedures for breaking ice. More particularly, it pertains to an improved icebreaking vessel equipped with a plow-type bow and a means for supplying an impulse force downwardly from the bow.

b. Description of the Prior Art

Icebreakers traditionally break ice in two alternative ways, namely: either by plowing continuously through the ice sheet relying on the downward force applied by a specially configured, highly raked bow structured to break the ice; or by a technique known as "boxing" or "ramming."

In plowing, a specially configured highly raked bow structure acts like a plow blade that runs under the ice sheet. The displacement of the vessel is that the bow runs under the ice sheet and the vessel is thus displaced downwardly. A moment is presented to the underside of the ice sheet. When the moment becomes sufficient to cause rupture of the ice, complete failure of the ice sheet occurs. This action causes the ice to plow over. This provided a very effective icebreaker as long as the thrust that was supplied by the power plant was sufficient to cause the bow to displace itself under the water, and thus to exert this moment. However, when the bow hits a pressure ridge it can no longer penetrate the ice because it is completely dependent upon the thrust produced by the power plant on the screws.

In boxing, an icebreaker runs its bow onto an ice sheet too thick to be broken by continuous plowing until the ship breaks through the ice at about which time the ship is either at rest in the ice or nearly so; after the ice is at least partially broken, the icebreaker is backed off the ice into the track of broken ice until it is clear of the ice sheet, and again driven to ram into and to ride up onto the ice.

Conventional ice breakers rely upon the mass of the vessel to accomplish breakage of the ice during both continuous plowing and boxing modes of operation. The forward end of an icebreaker may be ballasted to increase the effective portion of the overall mass of the vessel applied to the ice sheet, especially where the vessel becomes stuck on the ice during boxing of very thick ice sheets.

The effectiveness of an icebreaker, measured in terms of the thickness of ice capable of being broken during boxing mode operation, has been determined primarily by the displacement (total weight) of the vessel and by the efficiency with which the specially configured bows of these vessels transferred forward momentum and weight of the vessel downwardly to the ice. The basic objective has been to apply sufficient force downwardly to the ice or by the use of an upwardly acting icebreaker bow structure to cause the ice to break into pieces and to separate from the ice sheet.

The ratio of propulsive horsepower to displacement in icebreakers traditionally has been rather limited considering the task expected of such vessels. Propulsive horsepower has been limited to prevent the vessel from being driven so far up onto a thick ice sheet during boxing mode operation that the vessel cannot be backed off the ice. Bows for icebreakers also are designed to limit hull advance onto an ice sheet to the point where the vessel can be backed off if beached.

Other types of icebreakers have been described in Waas, et al, U.S. Pat. No. 2,902,964 in which weight was transferred cyclically in the vessel to induce pitching and other movements of the hull purportedly in resonance with the corresponding natural periods of the vessel in such movements. The patent describes the use of counterrotating eccentric weights in the vessel, and the shifting of water ballast fore and aft in the vessel; comment is also made therein that water can be pumped into and out of the vessel, all to pitch the vessel, purportedly in resonance with the natural period of the hull.

It is known that icebreakers which are equipped with rotating weight systems may operate to produce cyclic induced motion of the vessel at a frequency of 30 cycles per minute and preferably much greater. Induced pitch experienced at these frequencies by such mechanisms increased the icebreaking efficiency of such vessels. It has been found, for example, that when the induced motion system was operated, the bow of the vessel experienced vertical excursions of 10cm. (total amplitude) at the rate of 30 times a minute.

Thus, it has been discovered that the induced motion frequencies far exceeds the natural motion frequencies of usual icebreaking vessels. Such frequencies had no relation whatever to the natural frequencies of the hulls in question. It has been suggested that much higher frequencies (on the order of 120 cycles per minute) of induced motion would be even more effective. It is highly significant the such induced pitching motions are of small amplitude. It is also known that ballast systems, while effective to produce pitch in a ship under static conditions, cannot be used effectively to produce forces with sufficient rapidity to attain something of a ship's natural rythm of pitch. Thus, prior practical experience with induced hull movements for icebreakers involved high frequency, low amplitude movements resulting from effects internal to the hull.

In a different area pertaining to icebreakers, attempts have been made reliably to predict the areas in which energy is expended by an icebreaker operating during both continuous and boxing modes. It has been estimated that of the total energy expended by an icebreaker in breaking ice, 5% of the energy is consumed in actually breaking the ice, 80% is consumed in moving the ice out of the way of the vessel and in overcoming the buoyancy of the ice, and 15% is consumed in overcoming conventional hull resistance.

Another icebreaker proposal is the so-called RESOD system, based on a combustion explosion. The high pressure exhaust gases from a combustion chamber are emitted under the ice-sheet, and are caused to impinge on the bottom of the ice-sheet. This process has the principal disadvantage that the spacing of the exhaust outlets is exceptionally critical. If the exhaust outlets are spaced at exactly the right point, the energy is received in the ice-sheet and failure does occur. If the exhaust outlets are too close to the ice-sheet, the exhaust literally blows a hole through the ice. If the exhaust outlets are too far beneath the ice-sheet, the energy is absorbed in the water, and there is no fracture in the ice-sheet.

In the Anders Canadian Pat. No. 950,278 issued July 2, 1974 an economical, effective and efficient icebreaker was provided including a pneumatically biased pitch-inducing system which operated at a frequency selected to correspond to the optimum pitch energy transfer characteristic which exists between the vessel, and adjacent ice-sheet, and of broken ice between the ice-sheet and the vessel. Pitching is induced by effectively shifting the center of buoyancy of the vessel, rather than by shifting mass within the vessel. Such prior icebreaker was stated to be efficient in terms of required pitching horsepower because it relied upon the natural dynamic properties of the vessel to accomplish a significant portion of the buoyancy shifting, whereas prior pitch-inducing systems had to work against the dynamic properties of the vessel.

Such icebreakers differed from prior pitching icebreakers by providing low frequency, high amplitude movements of the bow. These high amplitude ship movements involve movement of substantial volumes of water, and water movement was controlled directly and indirectly to assist in moving ice out of the way of the hull in a track formed through an ice sheet. As a result, such icebreaker was able to exert a greater portion of the available power to the ice to be broken and effectively to break greater thicknesses of ice faster than had previously been possible. Such icebreaker operated more efficiently to move ice out of the way of the vessel, thereby significantly reducing what is now the major draim of energy available from the icebreaker.

Also, the bow of such icebreaker was arranged to apply pitching and forward momentum of the vessel to the ice-sheet during both upward and downward movements of the bow. Prior icebreakers operated to apply force only downwardly or upwardly to an ice-sheet.

AIMS OF THE INVENTION

An object of a broad aspect of this invention is to provide an icebreaker taking advantage of the desirable features of a plow-type bow, while greatly minimizing or even avoiding completely the disadvantage thereof.

An object of an another aspect of this invention is to provide an icebreaker operating efficiently and yet avoiding the complexities of a traditional pitching icebreaker.

SUMMARY OF THE INVENTION a. Broad Statements of the Invention

By one broad aspect of this invention a procedure is provided for breaking ice, which comprises: the cyclical steps of pretensioning an ice-sheet by plowing under a portion of the ice-sheet with the bow of an icebreaking vessel; superimposing on that pretensioned ice-sheet, a massive momentum force due to the reaction of an impulse force due to accelerating water rapidly downwardly from within a bow chamber; and refilling the bow chamber with water. In a preferred embodiment of such procedure, the impulse force is created by the high pressure exhaust gases from a combustion chamber being applied directly to the water.

By another aspect of this invention, an improved vessel is provided for use in ice-covered waters, comprising: (a) a hull having (1) a bow portion of plow-like, highly raked icebreaking configuration and (2) a water chamber therein and communicable through the hull below the waterline; (b) a source of forced impulses of high pressure gas communicating with the water chamber for cyclically displacing water contained therein rapidly downwardly, thereby creating a reactive force applied to the bow, the cycle having a period measured in terms of seconds and amplitude at the ends of the hull of magnitude of less than one foot; (c) apertures in the crown of the bow communicating directly with the water chamber, to permit water to refill the water chamber, and (d) means for cyclically admitting forced impulses of the high pressure gas to the water chamber at a selectable frequency within a range of frequencies having a period of several seconds.

b. Variants of the Invention

By yet another aspect of this invention, a procedure is provided for breaking ice which comprises: the cyclical steps of pretensioning an ice-sheet by plowing under a portion of the ice-sheet with the bow of an icebreaking vessel; superimposing on that pretensioned ice-sheet a massive force due to the reaction of an impulse force created by the high pressure exhaust gases from a combustion chamber being applied directly to water thereby causing water to accelerate rapidly downwardly from within a chamber in the bow; refilling the bow chamber with water; and directing the flow of high velocity high pressure, expanding gas at the bottom periphery of the bow in a radial direction, thereby tending to create a negative pressure in the area from the crest of the bow out to the outer periphery of the bow, to minimize the buoyancy of the ice-sheet.

By still another aspect of this invention, an improved floating vessel for use on ice-covered waters is provided, comprising: (a) a hull having a bow portion of plow-like, highly raked icebreaking configuration; and (b) means operatively associated with the hull and operated by forced impulses of high pressure, high velocity gases at a selectable frequency which is within a range of frequencies each of which has a period of several seconds, the means including a water chamber in the hull adjacent the bow thereof in direct communication with the ambient water through the hull below the waterline, such forced impulses of high pressure, high velocity gases serving explosively to discharge substantially all the water from the chamber, and means for re-admitting water to such chamber.

The present invention also provides auxiliary icebreaking action by causing the ice to break itself. Thus, when the gases, at seven to eight hundred pounds per square inch pressure reach the bottom of the bow, i.e., where they are no longer contained within the enclosure of the bow, then they will expand in a radial direction, i.e., in a horizontal direction in addition to the vertical expansion downwardly. At this point, with the high velocity, high pressure gas expanding radially outwardly at the bottom of the bow, a negative pressure tends to be set up in the area from the crest of the plow out to the outer periphery of the bow. In other words, water tends to be moved away from the ice-sheet so that the buoyancy of the ice-sheet is minimized. This minimization tends to cause the ice-sheet to fail under its own weight. By carefully directing the flow of gas at the bottom periphery of the bow, it is possible again to capitalize on the remnants of the gas energy that is left in the gas bubbles. Thus, the present invention provides for the accurate control of the gas expansion process after gaining the benefit from the acceleration portion.

DESCRIPTION OF THE DRAWINGS

Brief Descriptions of the Drawings

In the accompanying drawings, the single FIGURE is a side elevational view, partially in cross-section, of the forward end of an improved icebreaker of one aspect of this invention and shows in simplified form, the improved structure.

SPECIFIC DESCRIPTION OF THE DRAWING

As shown in the drawing, the improved icebreaking vessel 10 according to one embodiment of this invention includes a positively buoyant hull 11 of generally conventional configuration and arrangement, and including a bow of plowlike, highly raked structure to be described in greater detail hereinbelow. The hull 11 includes the conventional stern portion (now shown) i.e., conventional screw-type propellers and a conventional rudder. The vessel also includes a keel 16 and a main deck 17.

The bow structure is of generally plow-like configuration and is highly raked and includes a stem 18, a portion of high positive rake 19 and a portion of high negative rake 20, defining therebetween a curved nose 21 in the bow. Also included is a central ridge blade 35.

Disposed within the bow 12 is a water chamber 22 communicating via vents 23 to the crown of the bow 12 at the raked portion. Vents 23 are preferably provided with valves 24. The water chamber 22 is open to the bottom to communicate with the water. Also communicating directly with the water chamber 22 is the exhaust duct 24 of a combustion chamber 25, which preferably provides an explosive combustion. The combustion chamber is of the explosivetype combustion chamber and includes a compressed air inlet 36. Fuel inlets (not shown) are also provided. The exhaust duct 24 is provided with suitable valve means 26 at the inlet to the upper gas chamber portion of the water chamber 22. The combustion chamber is resiliently insolated by rubber 37 within the hull 11 of the vessel 10.

DESCRIPTION OF THE OPERATION OF THE SPECIFIC EMBODIMENT OF THIS INVENTION

The operation of the novel icebreaker of this apsect of the invention is a follows, reference being made to the drawing.

The bow 12 of the vessel first pretensions the ice-sheet 27 floating on the water 28 by ramming the ice-sheet 27 while simultaneously breaking the ice and scooping it up from under the water 28. At this time, the high pressure, high velocity, exhaust gases from the combustion chamber 25 are admitted to the water chamber 22, which is filled with water to the water line 37. This causes the water 31 in the water chamber 22 to be explosively, violently and very rapidly expelled from the water chamber 22. This provides a great upward force which tends to lift the vessel 10 out of the water. The high velocity, high pressure, gas at point F is caused to be directed radially outwardly, i.e., downwardly as arrow F1, rearwardly as arrow F3 and forwardly, under the floating ice-sheet 27 as arrow F2. This tends to destroy the buoyancy of the ice-sheet 27, which tends to fail, fissure and rupture under its own weight. The vessel 10 is moving all this time and again moves to a forward position to pretension the ice-sheet 27. The vents 23 are in communication with water 28 and with valves 24 open the water chamber 22 is permitted to refill with water 31 in the second half of the cycle. The explosive discharge of gas into the water chamber 22 then commences the next cycle. Thus, a basic concept of the present invention resides in combining an explosive device with a plow-type bow, and to provide a water chamber in the bow, so that the water therein is expelled as a free piston.

When the explosion occurs, the water that is trapped in the bow chamber 22 is displaced very very rapidly downwardly. This results in a downward acceleration force, the upward reactive force of which is applied to the bow and consequently is transmitted to the ice-sheet 22. There is thus an almost direct transfer of momentum from the force due to the water 31 being exploded out the bottom of the water chamber 22 in a time of the order of a microsecond, to a positive force against the ice-sheet, in addition to the prestress which has already been put to the ice-sheet due to the plow action of the bow.

It is, of course, essential to refill the bow chamber 22 with water 31 after each explosive cycle. In other words, when the water 31 is blown out of the bottom of the water chamber 22 the water acts as a free piston. The explosive force, of the order of 700 or 800 pounds per square inch of gas pressure acting over the cross-sectional area of the water chamber 22 accelerates the water downwardly in a piston effect. The piston must thereafter be returned to its original position. For that reason, the vents 23 are provided in the crown area, i.e., the plow 19 of the bow 12. These vents 23 are small, but are of sufficient size to permit a minimum of the high pressure gas to escape at the end of the compression process, but which are, however, of sufficient size to permit the water chamber to refill with water so that a new working surface is again provided.

It will also be observed that, as an optional feature, the vents 23 are valved 24 to provide the ability to be opened or closed.

COMPARISON WITH RELEVENT PRIOR ART

It will be observed that Canadian Pat. No. 950,278 provides a pitching chamber coupled with a static displacement due to the water being expelled from and admitted into, a pitching chamber. In the present invention, the action is of the impulse-type, while water is being displaced, but the volume of water displaced is insignificant to the force that is gained from the acceleration using the internal energy from the combustion process. In the present invention, the movement provided is very small but has tremendous forces.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such charges and modifications are properly, equitably, and "intended" to be, within the full range of equivalence of the following claims.

I claim:

1. A procedure for breaking ice which comprises the cyclical steps of: pretensioning an ice sheet by plowing under a portion of the icesheet with a plow portion of the bow of an icebreaking vessel; providing a mass of water within a chamber disposed within said plow portion of the bow of said vessel; and applying, to the mass of water in said chamber, exhaust gases from a combustion chamber, said gases having a pressure of at least about 700 psi thereby rapidly expelling said mass of water, in the form of a single free piston, and superimposing on said pretensioned ice sheet, a massive upward momentum force due to the upward reaction of the downwardly expelled water.

2. The procedure of claim 1 including the step of directing the flow of said high velocity, high pressure, expanding gas at the bottom periphery of said plow portion of the bow in a radial direction, thereby tending to create a negative pressure in the area from the crest of the bow out to the outer periphery of the bow, to minimize the buoyancy of the ice sheet.

3. An improved vessel for use in ice-covered waters comprising:

a. a hull having 1. a bow portion of plow-like, highly raked ice-breaking configuration and 2. a single water chamber disposed within said plow-like bow portion and communicable through the hull below the waterline;

b. a source of forced impulses of high pressure, a combustion chamber providing high velocity exhaust gases having a pressure of at least about 700 psi communicating directly with the water chamber, for cyclically displacing water contained therein rapidly downwardly, c. apertures in the crown of the bow communicating directly with the water chamber, to permit water to refill the water chamber; and d. means for cyclically admitting forced impulses of the high pressure gas to the water chamber, the cycle having a period measured in terms of seconds and an amplitude at the forward end of the hull of less than one foot.

4. The vessel of claim 3 wherein said apertures (c) are provided with valves, which are closed during the part of the cycle when said high pressure gas is being admitted to the water chamber, and are opened to readmit water to the water chamber.

5. A vessel according to claim 3 wherein the combustion chamber is resiliently isolated within the hull of the vessel.

* * * * *